US008332967B2

(12) United States Patent
Echikson

(10) Patent No.: US 8,332,967 B2
(45) Date of Patent: Dec. 18, 2012

(54) CONCEALMENT APPAREL

(75) Inventor: Lawrence K. Echikson, Dunwoody, GA (US)

(73) Assignee: Concealed Designs, LLC, Dunwoody, GA (US)

( * ) Notice: Subject to any disclaimer, the term of this patent is extended or adjusted under 35 U.S.C. 154(b) by 258 days.

(21) Appl. No.: 12/730,659

(22) Filed: Mar. 24, 2010

(65) Prior Publication Data

US 2011/0231982 A1 Sep. 29, 2011

Related U.S. Application Data

(60) Provisional application No. 61/626,670, filed on Mar. 24, 2009.

(51) Int. Cl.
*A41D 27/20* (2006.01)

(52) U.S. Cl. ..... 2/250; 2/115; 2/272

(58) Field of Classification Search ..... 2/115, 272, 2/77, 85, 86, 93, 94, 96, 97, 102, 51
See application file for complete search history.

(56) References Cited

U.S. PATENT DOCUMENTS 2,150,251 A * 3/1939 Shanhouse ..... 2/94
2,810,132 A 10/1957 Nicholson
2,919,443 A 1/1960 Kashiyama
3,311,926 A * 4/1967 Gerber ..... 2/128
3,994,026 A * 11/1976 Sampey ..... 2/79
4,106,121 A 8/1978 Belson
4,171,542 A * 10/1979 Cox et al. ..... 2/51
4,235,356 A * 11/1980 Atchisson ..... 224/192
4,262,832 A 4/1981 Perkins
4,266,297 A * 5/1981 Atkins ..... 2/2.5
4,507,802 A * 4/1985 Small ..... 2/2.5
4,545,079 A 10/1985 Bakken
4,570,268 A * 2/1986 Freeman ..... 2/114
4,637,075 A * 1/1987 Ingrisano et al. ..... 2/94
4,665,564 A * 5/1987 Bogart et al. ..... 2/119
4,882,786 A 11/1989 Gross
4,966,320 A 10/1990 DeSantis et al.
4,998,654 A 3/1991 Bruzek et al.
5,157,792 A * 10/1992 Allen et al. ..... 2/2.5
5,170,919 A 12/1992 DeSantis et al.
5,201,075 A * 4/1993 Svetich ..... 2/108
5,278,998 A 1/1994 Book
5,294,031 A 3/1994 Volpei
5,325,538 A * 7/1994 Schoenweiss et al. ..... 2/2.5
5,331,683 A * 7/1994 Stone et al. ..... 2/2.5
5,392,466 A * 2/1995 Chou et al. ..... 2/114
5,431,318 A 7/1995 Garcia
5,507,042 A * 4/1996 van der Slessen ..... 2/69
5,564,126 A * 10/1996 Chou ..... 2/114
5,655,222 A * 8/1997 Grilliot et al. ..... 2/81
5,689,829 A 11/1997 Rose
5,692,237 A 12/1997 Bennett (Continued)

*Primary Examiner* — Khoa Huynh
*Assistant Examiner* — Andrew W Collins
(74) *Attorney, Agent, or Firm* — FisherBroyles, LLP; Anthony J. DoVale

(57) ABSTRACT

Apparel for the concealment of articles. Presented is a shirt that allows fast and safe retrieval of a concealed weapon. The shirt can have multiple access points to allow the wearer to retrieve weapons holstered in a shoulder type rig, against the waistband ("AWB") holster, or a "belly-band" type holster. The shirt comprises a shell substantially in the shape of a shirt and an inner panel substantially lining at least a portion of the interior portion of the shell. The shell defines at least one access port configured to be selectively opened or closed to enable selective access to an interior portion of the shell.

21 Claims, 6 Drawing Sheets

U.S. PATENT DOCUMENTS

| | | | | |
|---|---|---|---|---|
| 5,845,336 | A | 12/1998 | Golde | |
| 5,894,976 | A | 4/1999 | Harper | |
| D414,014 | S | 9/1999 | Blankenship | |
| 6,119,270 | A * | 9/2000 | Chou | 2/108 |
| 6,131,198 | A | 10/2000 | Westrick | |
| 6,155,468 | A | 12/2000 | Kinnich | |
| 6,324,697 | B1 | 12/2001 | Shofner | |
| 6,339,848 | B1 * | 1/2002 | Mayhood et al. | 2/338 |
| 6,760,922 | B1 | 7/2004 | Morales | |
| 6,986,164 | B1 | 1/2006 | Morales | |
| D579,178 | S * | 10/2008 | Snyder et al. | D2/840 |
| 7,454,798 | B2 * | 11/2008 | Feodoroff | 2/114 |
| 7,845,024 | B2 * | 12/2010 | Hill | 2/310 |
| 7,891,023 | B1 * | 2/2011 | Hill | 2/310 |
| 7,926,448 | B2 * | 4/2011 | Fox | 119/497 |
| 7,987,524 | B2 * | 8/2011 | Bower | 2/106 |
| D648,924 | S * | 11/2011 | Propst | D2/828 |
| 2002/0189000 | A1 | 12/2002 | Jordan | |
| 2005/0005341 | A1 * | 1/2005 | Roux et al. | 2/69 |
| 2005/0223466 | A1 | 10/2005 | Jennings et al. | |
| 2006/0162041 | A1 * | 7/2006 | Tengbom et al. | 2/85 |
| 2006/0218690 | A1 * | 10/2006 | James | 2/69 |
| 2007/0028368 | A1 * | 2/2007 | Morton | 2/265 |
| 2009/0235431 | A1 * | 9/2009 | Bevley | 2/227 |

* cited by examiner

CONCEALMENT APPAREL

CONTINUITY DATA

This application claims the benefit of and priority to U.S. Provisional Application Ser. No. 61/626,670, filed on Mar. 24, 2009, which is incorporated herein in its entirety.

FIELD OF THE INVENTION

This invention relates to apparel for the concealment of articles, such as hand guns. Specifically, the invention relates to a shirt designed to conceal articles, such as hand guns, holstered in a variety of manners.

BACKGROUND OF THE INVENTION

Often times, it is necessary for a person to carry an item in an article of clothing that the wearer does not want to be noticed. For instance, off-duty police officers must carry their weapons and may wish for them to be concealed from the public. Currently, the options are limited with respect to apparel for concealing articles, such as weapons. For instance, many officers merely wear shirts that are baggy and not tucked-in. This limits the officer's options with respect to styles and fashions.

There are many other situations in which a person may wish to conceal articles stored in clothing or on their person. Another example may be the traveler wishing to conceal a wallet or other such item.

Therefore, what is needed is apparel that not only enables concealment of items, but also permits the wearer to broaden their choices with respect to styles and fashions.

SUMMARY

Presented herein is a shirt that allows fast and safe retrieval of a concealed weapon. The shirt can have multiple access points to allow the wearer to retrieve weapons holstered in a shoulder type rig, against the waistband ("AWB") holster, or a "belly-band" type holster. The shirt comprises a shell substantially in the shape of a shirt and an inner panel substantially lining at least a portion of the interior portion of the shell.

In one aspect, the shell defines at least one access port configured to be selectively opened or closed to enable selective access to an interior portion of the shell. The access port is configured for ready access to a weapon holstered by the wearer in a belly-band holster, as known in the art.

In another aspect, the shirt comprises an inner panel substantially lining at least a portion of the interior portion of the shell and can define at least two slits therein, configured for receipt of a portion of a belly-band holster, whereby, in use a weapon holstered within the belly-band holster would be positioned there between the inner panel and the shell.

It is contemplated that the shirt is a button down style shirt that comprises a placket substantially bisecting the front first portion of the shell and the front second portion of the shell. The placket forms a false front comprising a plurality of buttons not meant for use, whereby the shell has the appearance of a normal button-down shirt.

In one aspect, the inner panel substantially lines at least a portion of the shell corresponding to the front first portion from an area adjacent a top portion of the shell to a distal portion of the bottom cut of the shell. It is contemplated that the inner panel can substantially line both front first portions of the shell and may also line rear portions of the shell.

The distal portion of the bottom cut of the front first portion of the shell can be configured to be selectively moved from a relaxed position, whereby the distal portion of the bottom cut of the front first portion of the shell is substantially extended, or a bloused position, whereby the distal portion of the bottom cut of the front first portion of the shell is turned inwardly upward and retained by a fastening surface thereon a portion of the bottom cut of the front first portion of the shell.

Other aspects and embodiments of the shirt are described herein. This description is meant to fully describe the shirt, but not limit its design, function, or application.

DETAILED DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
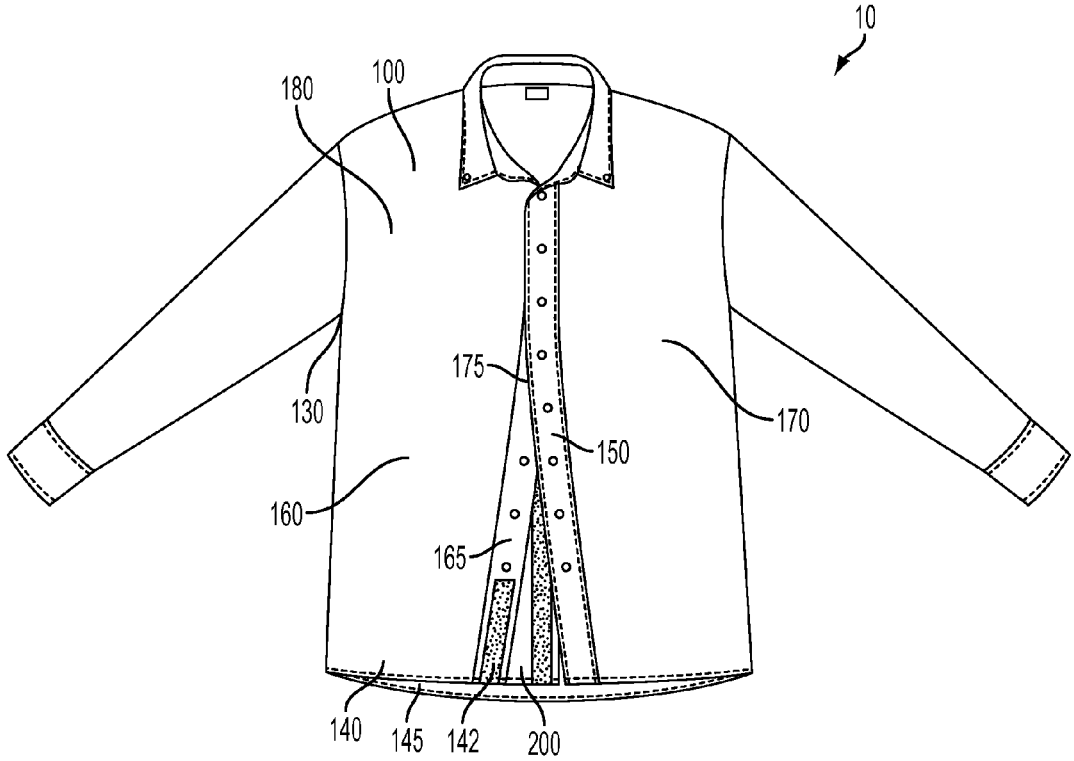
FIG. 1 is a front view of one aspect of a shirt for concealing articles, showing the outer shell and the inner panel.
Figure 2:
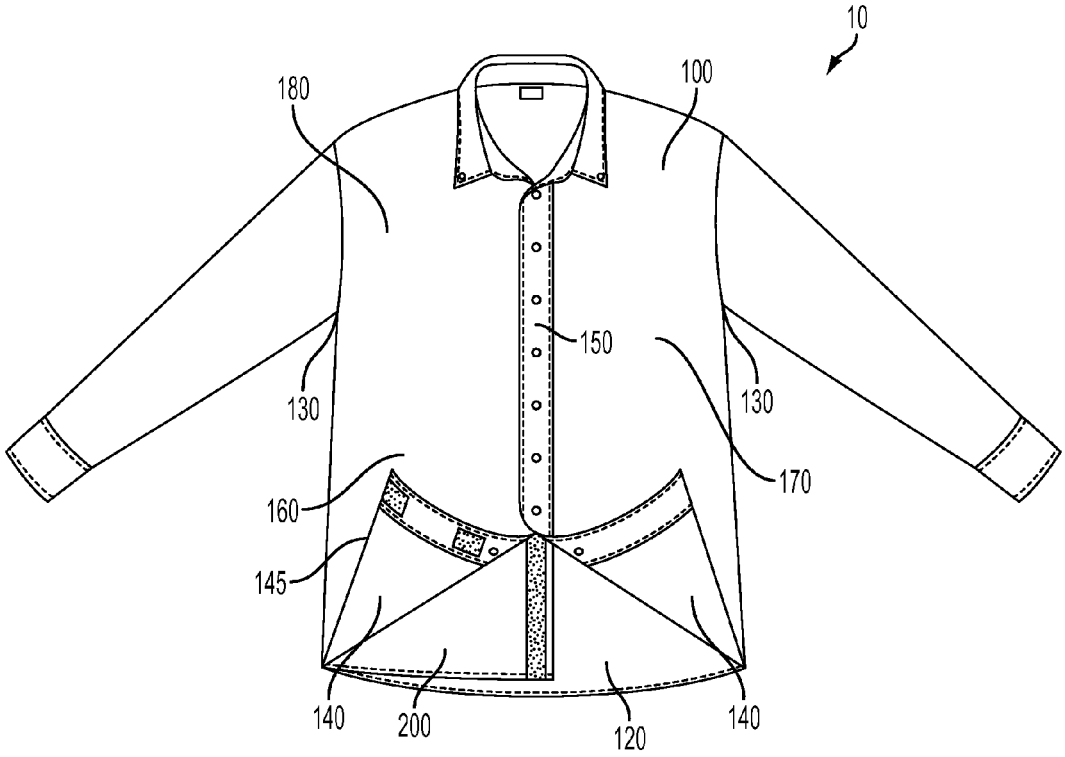
FIG. 2 is a front view of the shirt of FIG. 1, showing the distal portion of the bottom cut of the first front portion of the shell.
Figure 3:
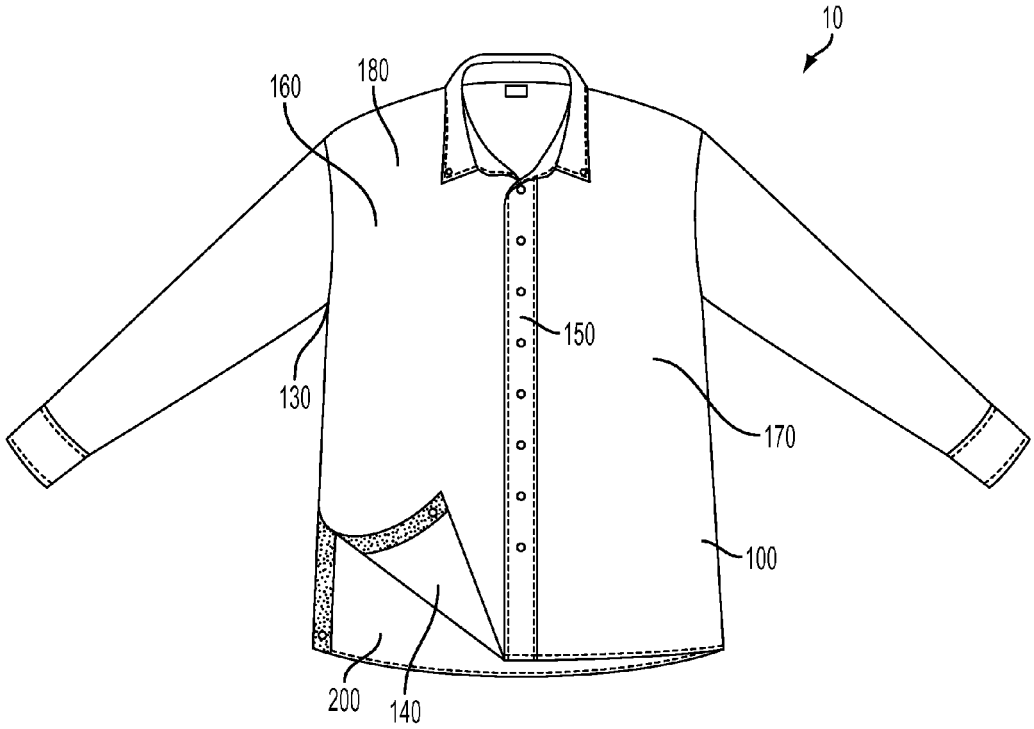
FIG. 3 is a front view of the shirt of FIG. 1, showing the bottom cut of the first front portion.
Figure 4:
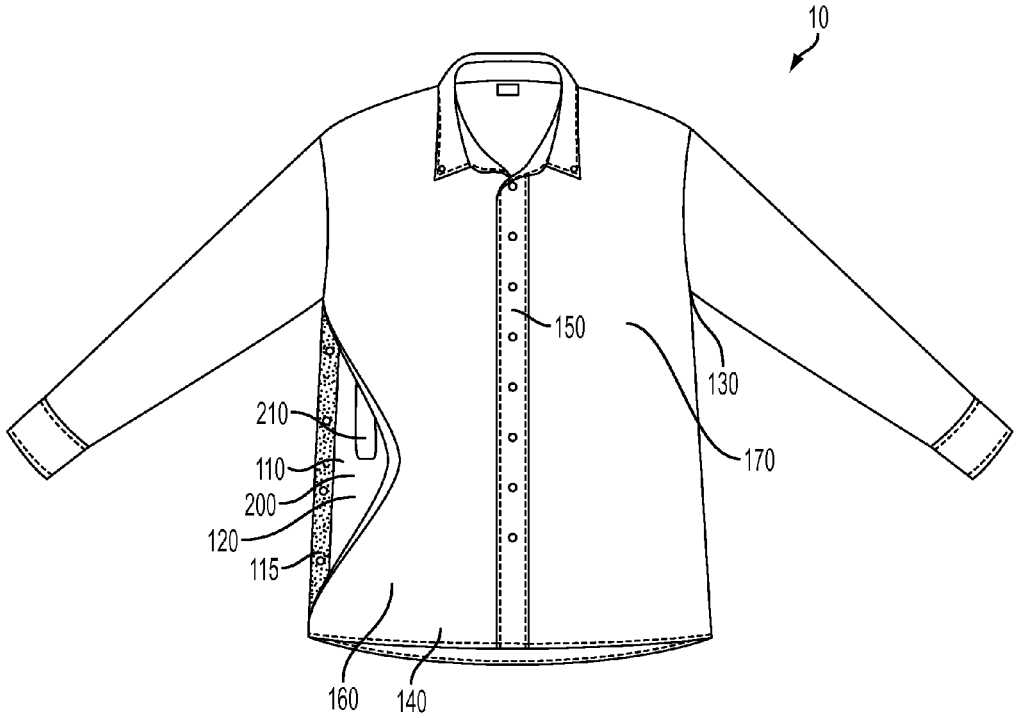
FIG. 4 is a front view of the shirt of FIG. 1, showing an access port.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a pocket" can include two or more such pockets unless the context indicates otherwise.

Ranges can be expressed herein as from "about" one particular value, and/or to "about" another particular value.

When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Presented herein is a shirt that allows fast and safe retrieval of a concealed weapon. The shirt can have multiple access points to allow the wearer to retrieve weapons holstered in a shoulder type rig, against the waistband ("AWB") holster, or a "belly-band" type holster.

In one exemplary aspect, presented herein is a shirt 10 for concealment of a firearm, comprising a shell 100 substantially in the shape of a shirt and an inner panel 200 substantially lining at least a portion of the interior portion 120 of the shell 100.

In one aspect, the shell defines at least one access port 110 configured to be selectively opened or closed to enable selective access to an interior portion 120 of the shell. The access port 110 is configured for ready access to a weapon holstered by the wearer in a belly-band holster, as known in the art. As one skilled in the art can appreciate, the holster can be worn on either side of the wearer's body. As such, the access port can be positioned adjacent the holster on either, or both, sides of the shell 100. In another aspect, the access port exterior appears as a small seam making it appear as a design feature of the shirt, or may otherwise be camouflaged in its closed position. In still another aspect, the access port is positioned substantially vertically between an underarm portion 130 of the shell and the bottom cut 140 of the shell. It is also contemplated that the access port 110 can provide access to other weapons or law enforcement equipment, such as, for example, handcuffs or mace.

In one exemplary aspect, the access port comprises a releasable fastener 115 for ease of access for the wearer and ease of closing the access port when necessary. The releasable fastener 115 can comprise, for example and not meant to be limiting, hook and loop material. The hook and loop material can actually be a plurality of spaced hook and loop portions spaced along the access port 110 sufficiently for a wearer of the shirt to position at least one finger therebetween adjacent hook and loop portions for easy access to the interior portion of the shell 100. In another aspect, the releasable fastener comprises a plurality of snaps spaced along the access port sufficiently for a wearer of the shirt to position at least one finger therebetween adjacent snaps for easy access to the interior portion of the shell.

In one aspect, the shirt comprises an inner panel 200 substantially lining at least a portion of the interior portion 120 of the shell, as shown in FIGS. 2-6. In another aspect, the inner panel defines at least two slits 210 therein, configured for receipt of a portion of a belly-band holster, whereby, in use a weapon holstered within the belly-band holster would be positioned therebetween the inner panel and the shell 100.

It is contemplated that the shirt is a button down style shirt that comprises a placket 150 substantially bisecting the front first portion 160 of the shell and the front second portion 170 of the shell. The placket 150 is positioned thereon a longitudinal edge 175 of the front second portion 170 of the shell and forms a false front comprising a plurality of buttons not meant for use, whereby the shell 100 has the appearance of a normal button-down shirt, and wherein the placket has a back face 155 configured for mating selective engagement with a longitudinal edge 165 of the front first portion 160 of the shell. In fact, in one aspect, the back face 155 of the placket comprises a releasable material and the front face 165 of the adjacent front portion of the shell comprises a matable releasable material. The releasable material can comprise hook and loop material, buttons, snaps, and the like. It is also contemplated that this relationship can be in the reverse.

Figure 5:
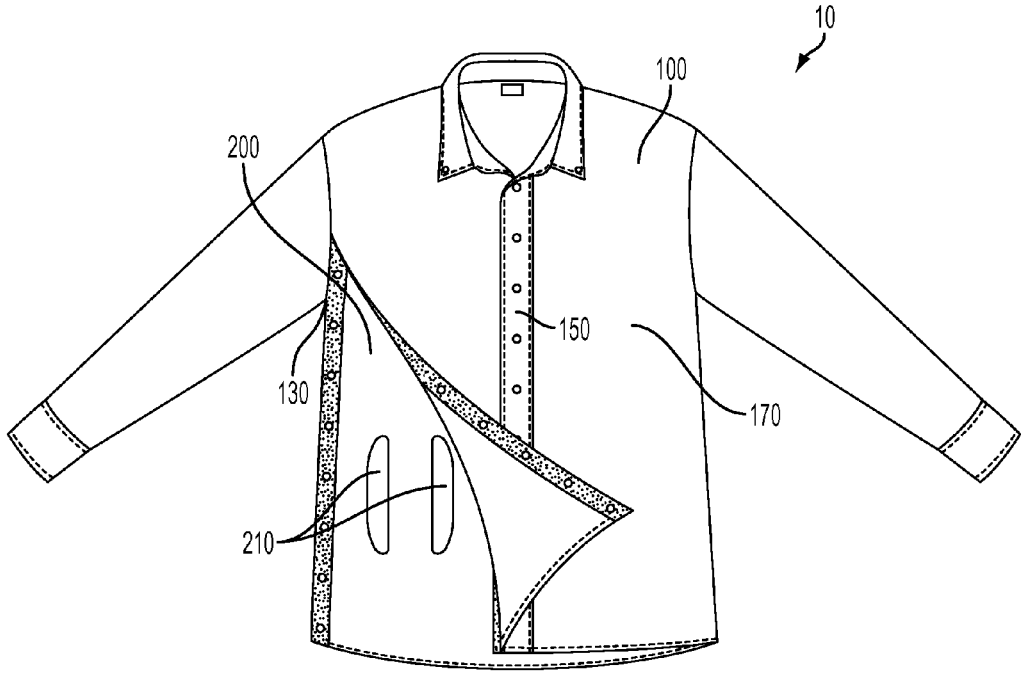
FIG. 5 is a front view of the shirt of FIG. 1, showing the slits defined therein the inner panel.

In one aspect, as shown in FIG. 5, the inner panel 200 substantially lines at least a portion of the shell corresponding to the front first portion. In another aspect, the inner panel substantially lines the interior portion of the shell 100 from an area adjacent a top portion 180 of the shell to a distal portion 145 of the bottom cut 140 of the shell. It is contemplated that the inner panel can substantially line both front portions of the shell 100 and may also line rear portions of the shell.

Figure 6:
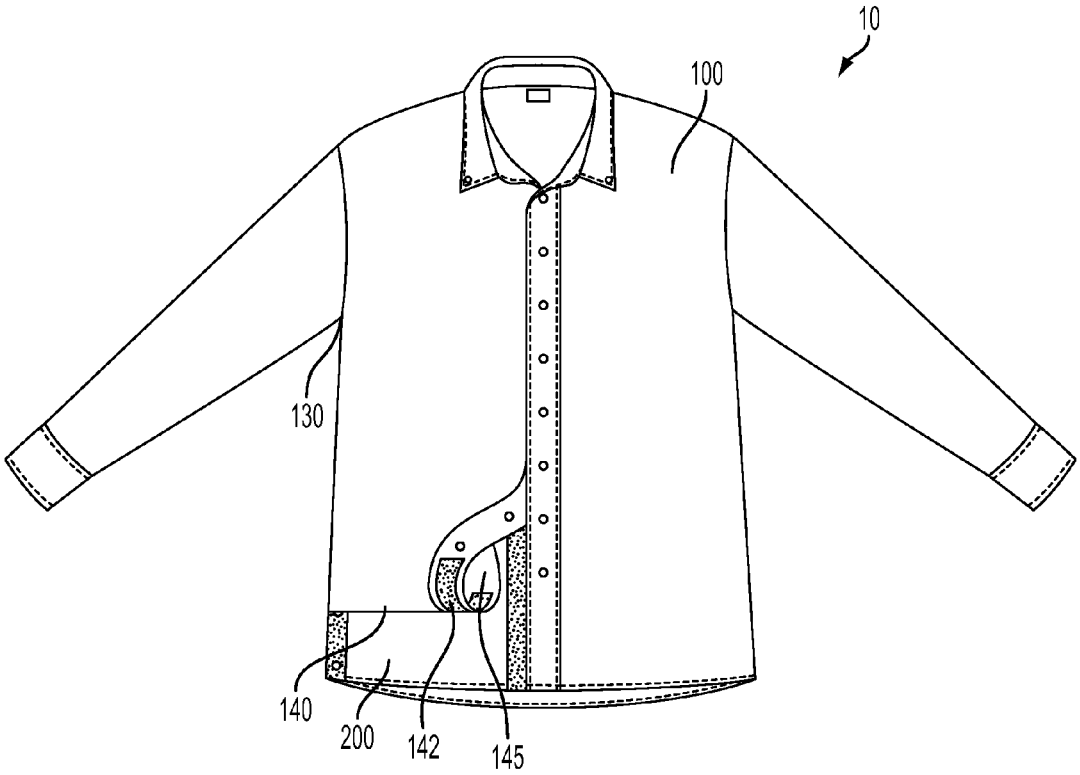
FIG. 6 is a front view of the shirt of FIG. 1, showing the distal portion of the bottom cut of the first front portion of the shell in the bloused position.

As illustrated in FIG. 6, in one aspect, the distal portion 145 of the bottom cut of the front first portion of the shell is configured to be selectively moved from a relaxed position, whereby the distal portion of the bottom cut of the front first portion 160 of the shell is substantially extended, or a bloused position (shown in FIG. 6), whereby the distal portion of the bottom cut 140 of the front first portion of the shell is turned inwardly upward and retained by a fastening surface 142 thereon a portion of the bottom cut of the front first portion 160 of the shell 100. In this aspect, the bottom cut of the inner panel 200 can be tucked into the wearer's pants, leaving the distal portion 145 of the bottom cut 140 of the shell in the bloused position to substantially cover and conceal a weapon holstered in an against the waistband ("AWB") or an inside the waistband ("IWB") holster, as known in the art, or other types of holsters including handguns with a built in retainer clip which replaces the need for a separate holster device.

In another aspect, the design described in the previous paragraph may be altered such that the distal portion of the bottom cut of the back portion of the shell is selectively movable from the substantially extended position to a bloused position to accommodate rear access to a "small of the back" type holster.

In one exemplary aspect, the shell 100 comprises an interior pocket (not shown) in the vicinity of the access port and/or the front placket 150. As such, the wearer can store travel articles or documents in the interior pocket that can be access via the access port or via the front placket. The interior pocket can also comprise a water-resistant material and can be sufficiently closable.

As one skilled in the art can appreciate, the shirt can comprise a traditional collar, a turtle-neck, or a crew neck. It can be button-down or pull-over. It can be manufactured of any suitable material, such as cotton, nylon blend, and the like. It is contemplated that the shirt can be short sleeve, long sleeve, or sleeveless. The bottom cut may comprise shirt tails or a rounded cut. In essence, the shirt can comprise any variation of shirt styles to incorporate the design advantages described herein.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

The invention claimed is:

1. A shirt for concealment of a firearm, comprising:

a shell substantially in the shape of a shirt having a shirt front, a shirt rear, and at least one bottom cut, wherein the shell defines at least one access port configured to be selectively opened or closed to enable selective access to an interior portion of the shell;

an inner panel substantially lining at least a portion of the interior portion of the shell, the inner panel comprising a plurality of slits therein which provide substantially open communication with a rear surface of said inner panel, configured for receipt of a portion of a belly-band holster, whereby, in use a weapon holstered within the belly-band holster would be positioned there between the inner panel and the shell and wherein a distal edge of said inner panel is substantially unsecured to said shell.

2. The shirt of claim 1, wherein the access port is positioned substantially vertically between an underarm portion of the shell and the bottom cut of the shell.

3. The shirt of claim 2, wherein the access port comprises a releasable fastener.

4. The shirt of claim 3, wherein the releasable fastener comprises hook and loop material.

5. The shirt of claim 4, wherein the hook and loop material comprises a plurality of spaced hook and loop portions spaced along the port sufficiently for a wearer of the shirt to position at least one finger therebetween adjacent hook and loop portions for easy access to the interior portion of the shell.

6. The shirt of claim 3, wherein the releasable fastener comprises a plurality of snaps spaced along the access port sufficiently for a wearer of the shirt to position at least one finger therebetween adjacent snaps for easy access to the interior portion of the shell.

7. The shirt of claim 1, wherein the access port is substantially camouflaged in its closed position.

8. The shirt of claim 1, wherein the shirt is a button down shirt comprising a placket substantially bisecting a front first portion of the shell and a front second portion of the shell.

9. The shirt of claim 8, wherein the inner panel substantially lines at least a portion of the shell corresponding to the front first portion.

10. The shirt of claim 9, wherein the inner panel substantially lines the interior portion of the shell from an area adjacent a top portion of the shell to a distal portion of the bottom cut of the shell.

11. The shirt of claim 10, wherein the distal portion of the bottom cut of the front first portion of the shell is configured to be selectively moved from a relaxed position, whereby the distal portion of the bottom cut of the front first portion of the shell is substantially extended, or a bloused position, whereby the distal portion of the bottom cut of the front first portion of the shell is turned inwardly upward and retained by a fastening surface thereon a portion of the bottom cut of the front first portion of the shell.

12. The shirt of claim 8, wherein the placket is positioned thereon a longitudinal edge of the front second portion of the shell and forms a false front, whereby the shell has the appearance of a normal button-down shirt, and wherein the placket has a back face configured for mating selective engagement with a longitudinal edge of the front first portion of the shell.

13. A shirt for concealment of a firearm, comprising:

a shell substantially in the shape of a shirt having a shirt front, a shirt rear, and at least one bottom cut;

a placket substantially bisecting a front first of the shell and a front second portion of the shell;

an inner panel substantially lining at least a portion of the interior portion of the shell corresponding to the front first portion from an area adjacent a top portion of the shell to a distal portion of the bottom cut of the shell and wherein a distal edge of said inner panel is substantially unsecured to said shell, said inner panel further defining a plurality of slits which provide substantially open communication with a rear surface of said inner panel;

wherein the distal portion of the bottom cut of the front first portion of the shell is turned inwardly up and retained in the bloused position while the corresponding portion of the inner panel remains extended in the relaxed position.

14. The shirt of claim 13, wherein the placket is positioned thereon a longitudinal edge of the front second portion of the shell and forms a false front, whereby the shell has the appearance of a normal button-down shirt, and wherein the placket has a back face configured for mating selective engagement with a longitudinal edge of the front first portion of the shell.

15. The shirt of claim 14, wherein the shell defines at least one access port positioned substantially vertically between an underarm portion of the shell and the bottom cut of the shell and configured to be selectively opened or closed to enable selective access to an interior portion of the shell.

16. The shirt of claim 15, wherein said plurality of slits are configured for receipt of a portion of a belly-band holster, whereby, in use a weapon holstered within the belly-band holster would be positioned therebetween the inner panel and the shell.

17. The shirt of claim 16, wherein the access port comprises a releasable fastener.

18. The shirt of claim 17, wherein the releasable fastener comprises hook and loop material.

19. The shirt of claim 18, wherein the hook and loop material comprises a plurality of spaced hook and loop portions spaced along the port sufficiently for a wearer of the shirt to position at least one finger therebetween adjacent hook and loop portions for easy access to the interior portion of the shell.

20. The shirt of claim 17, wherein the releasable fastener comprises a plurality of snaps spaced along the access port sufficiently for a wearer of the shirt to position at least one finger therebetween adjacent snaps for easy access to the interior portion of the shell.

21. The shirt of claim 15, wherein the access port is substantially camouflaged in its closed position.

* * * * *